US009797144B2

(12) United States Patent
Maurer et al.

(10) Patent No.: US 9,797,144 B2
(45) Date of Patent: Oct. 24, 2017

(54) SIDING PANEL SYSTEM

(71) Applicant: Tapco International Corporation, Wixom, MI (US)

(72) Inventors: Michael W. Maurer, Walled Lake, MI (US); Clyde G. Allen, Columbiaville, MI (US); Daniel W. King, Copley, OH (US); James C. Parks, Carlisle, OH (US); Jeffrey B. Martin, Newtown, CT (US)

(73) Assignee: Tapco International Corporation, Wixom, MI (US)

( * ) Notice: Subject to any disclaimer, the term of this patent is extended or adjusted under 35 U.S.C. 154(b) by 0 days.

(21) Appl. No.: 14/252,869

(22) Filed: Apr. 15, 2014

(65) Prior Publication Data

US 2015/0292214 A1 Oct. 15, 2015

(51) Int. Cl.
*E04F 13/08* (2006.01)
*E04F 13/18* (2006.01)

(52) U.S. Cl.
CPC ..... *E04F 13/0864* (2013.01); *E04F 13/0846* (2013.01); *E04F 13/185* (2013.01)

(58) Field of Classification Search
CPC ..... E04F 13/0864; E04F 13/185
See application file for complete search history.

(56) References Cited

U.S. PATENT DOCUMENTS

| | | | | |
|---|---|---|---|---|
| 3,621,625 | A * | 11/1971 | Medow | 52/314 |
| 3,968,610 | A * | 7/1976 | Medow | 52/314 |
| 4,223,490 | A * | 9/1980 | Medow | 52/98 |
| 5,040,348 | A * | 8/1991 | King et al. | 52/533 |
| 7,587,871 | B2 * | 9/2009 | Perry | E04F 13/185 52/536 |
| 8,359,804 | B2 | 1/2013 | Wakefield | |
| 8,397,459 | B2 * | 3/2013 | Gately | 52/539 |
| 8,782,988 | B2 * | 7/2014 | Wolf et al. | 52/539 |
| 8,863,461 | B2 * | 10/2014 | Wagner | E04F 13/0837 52/314 |
| 2007/0011966 | A1 * | 1/2007 | Justice et al. | 52/309.1 |
| 2008/0185745 | A1 * | 8/2008 | Strout et al. | 264/35 |
| 2009/0293401 | A1 * | 12/2009 | Lappin et al. | 52/478 |
| 2012/0073217 | A1 * | 3/2012 | Wilson et al. | 52/105 |
| 2014/0202106 | A1 * | 7/2014 | Wagner et al. | 52/520 |
| 2014/0202109 | A1 * | 7/2014 | Michalski et al. | 52/588.1 |

* cited by examiner

*Primary Examiner* — Andrew J Triggs
(74) *Attorney, Agent, or Firm* — Quinn IP Law

(57) ABSTRACT

A panel configured for attachment to a mounting surface includes a plurality of raised faces that are formed between an upper edge and a lower edge of the panel. A shoulder is defined on the raised faces adjacent the upper edge and is spaced from the mounting surface, when assembled or attached thereto, by a shoulder offset. A plurality of keyways are recessed between each of the raised faces and are spaced from the mounting surface by a bottom keyway offset adjacent to the butt edge. The bottom keyway offset is substantially aligned with the shoulder offset.

7 Claims, 3 Drawing Sheets

SIDING PANEL SYSTEM

TECHNICAL FIELD

This disclosure relates to siding or roofing panel systems for attachment to mounting surfaces.

BACKGROUND

Exterior siding or roofing systems may include a plurality of panels, with each of the panels formed to simulate a plurality of individual decorative units. For example, each panel may emulate a plurality of wooden shakes or shingles. As such, each decorative unit is formed to simulate a single shake or shingle. Furthermore, the decorative units may be formed to simulate other siding materials, including stone, tile, et cetera.

SUMMARY

A panel for attachment to a mounting surface is provided. The panel defines a mounting plane that is substantially coincident with the mounting surface to which the panel will be attached. The panel includes a lock edge configured to contact the mounting plane and a butt edge defined opposite the lock edge.

A plurality of raised faces are formed between the lock edge and the butt edge. A shoulder is defined on the raised faces adjacent the lock edge. The shoulder is spaced from the mounting plane by a shoulder offset.

A plurality of keyways are recessed between each of the raised faces. The keyways are spaced from the mounting plane by a bottom keyway offset adjacent to the butt edge. The bottom keyway offset is substantially equal to the shoulder offset.

The above features and advantages, and other features and advantages, of the present invention are readily apparent from the following detailed description of some of the best modes and other embodiments for carrying out the invention, which is defined solely by the appended claims, when taken in connection with the accompanying drawings.

DETAILED DESCRIPTION

Figure 1:
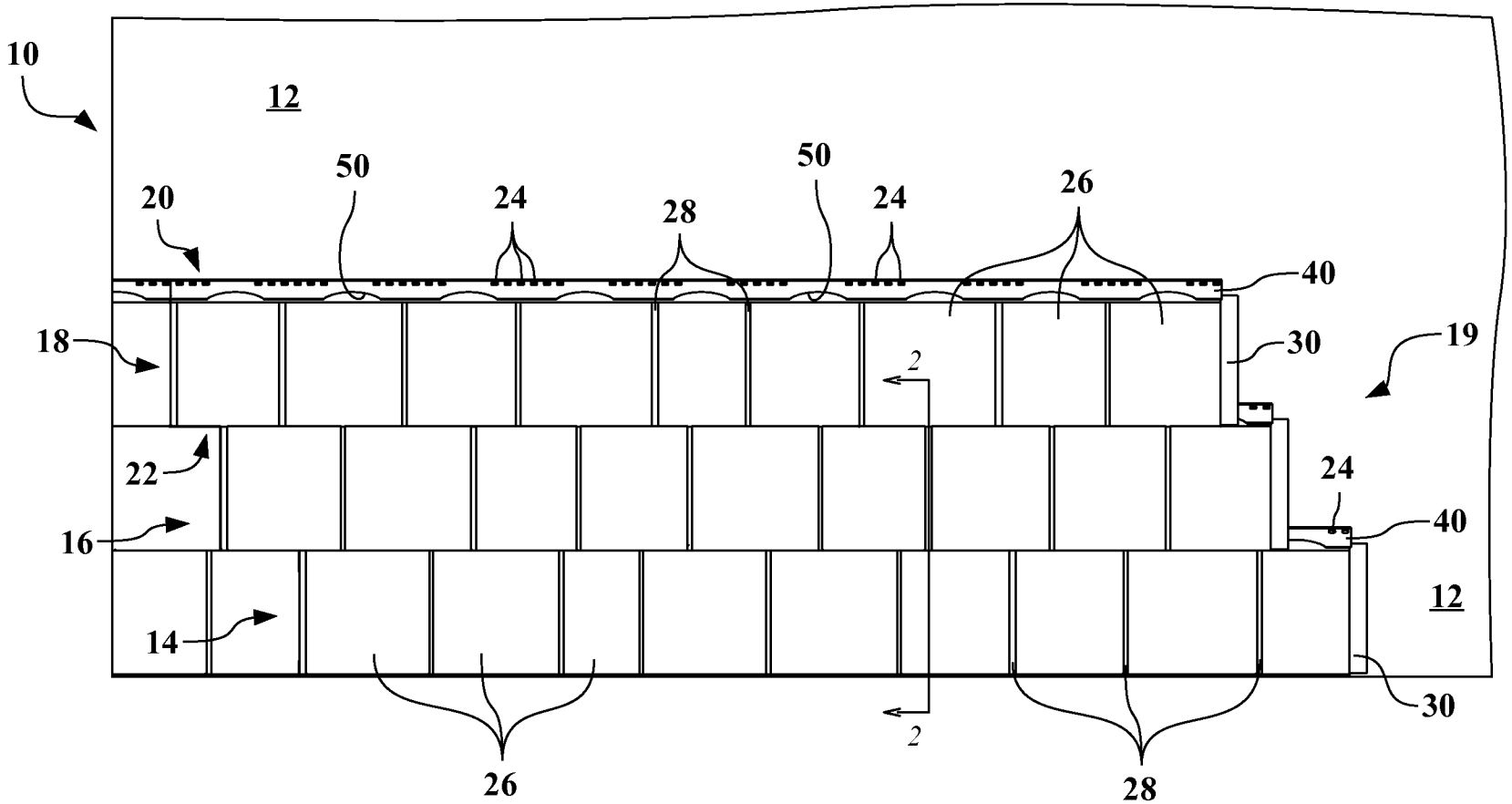
FIG. 1 is a schematic plan view of a siding system having a plurality of panels.

Referring to the drawings, like reference numbers correspond to like or similar components wherever possible throughout the several figures. There is shown in FIG. 1 a siding system 10 for attachment to a mounting surface 12. The siding system 10 may alternatively be attached to roofs or angled walls, such that the mounting surface 12 may be an angled wall or a roof surface.

The siding system 10 includes at least a first panel 14 and a second panel 16, and likely includes a third panel 18. The second panel 16 and the third panel 18 have similar features to the first panel 14, such that they may be referred to collectively or generically as panels 19. Each of the panels 19 is formed from a substrate material having substantially-constant thickness. The rearward side of the panels 19 define a mounting plane, particularly when assembled to each other, which may be substantially coincident with the mounting surface 12.

While the present invention may be described with respect to specific applications or industries, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims. Any numerical designations, such as "first" or "second" are illustrative only and are not intended to limit the scope of the invention in any way.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

Figure 2:
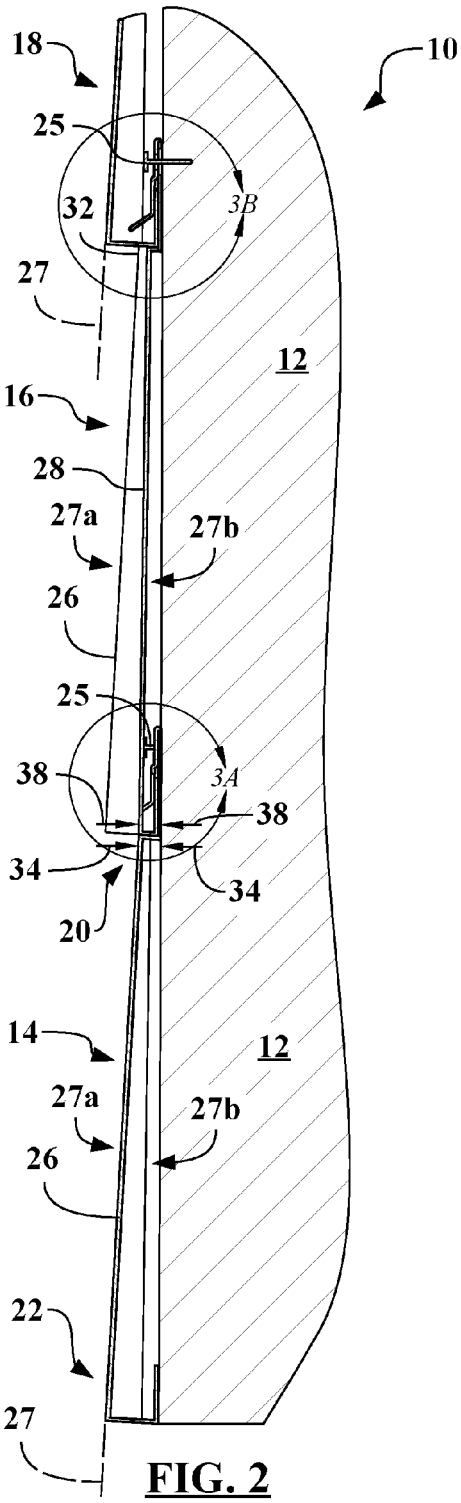
FIG. 2 is a schematic cross-sectional view taken generally along line 2-2 of FIG. 1.

Referring also to FIG. 2, and with continued reference to FIG. 1, there is shown a schematic side view of portions of the siding system 10. FIG. 2 shows a cross-sectional view of the first panel 14, the second panel 16, and the third panel 18.

Features of the first panel 14, the second panel 16, and the third panel 18 will be described with reference to FIG. 1 and FIG. 2. The described features of the panels 19 may refer to any of the first panel 14, the second panel 16, or the third panel 18. Note that manufacturing variance may lead to natural differences between panels 19 that are, otherwise, intended to be identical.

The panels 19 may be formed from different types of plastic or composite materials. For example, and without limitation, the panels 19 may be formed from vinyl, polypropylene, et cetera. Furthermore, the panels 19 may be formed as unitary, one-piece components, such that each of the first panel 14, the second panel 16, and the third panel 18 is a single component formed from a single piece of material (a single substrate), without subsequent attachment of pieces formed separately to complete each of first panel 14, the second panel 16, and the third panel 18.

The panels 19 include a fastener edge or lock edge 20 defined along one edge, and is shown on a top or upper edge in FIGS. 1 and 2. A lap edge or butt edge 22 is defined opposite the lock edge 20, and is shown on a bottom or lower edge in FIGS. 1 and 2. As viewed in the figures, the lock edge 20 is toward the top of each panel 19 and the butt edge 22 is toward the bottom of each panel 19. References to upper and lower directions, regions, or portions are defined relative to gravity and, therefore, to the general flow direction of water or moisture over the panels 19 and the structures to which they are mounted (although wind may cause water to move opposite gravity).

The lock edge 20 contacts the mounting surface 12 and has a plurality of fastener holes 24 defined there through. The fastener holes 24 are configured to mount the panels 19 to the mounting surface 12 with a plurality of fasteners 25, which may include nails, screws, staples, et cetera. The fastener holes 24, fasteners 25, and mounting surface 12 are shown schematically in FIG. 2 to illustrate attachment. In some embodiments, the fastener holes 24 may not be fully defined through the lock edge 20 but may instead be areas designated or identified for piercing by the fasteners 25, such that the fasteners at least partially pierce the material forming the panels 19.

A plurality of raised faces 26 are formed between the lock edge 20 and the butt edge 22. The raised faces 26 shown generally simulate wooden shingles, and have variable widths, as shown in FIG. 1. The raised faces 26 generally define a plane or face plane 27, as illustrated by dashed lines extending from the raised face 26 of the first panel 14 in FIGS. 2 and 3A and the third panel 18 in FIG. 2, and as viewable in other figures and on other panels. Leftward of the face plane 27, as viewed in the figures, is a side of the raised faces 26 that is opposite, or facing away, from the mounting surface 12; this side may be referred to as an outside 27*a* of the panels 19. Similarly, rightward of the face plane 27, as viewed in the figures, is a side of the raised faces 26 that is nearer to, or facing toward, the mounting surface 12; this side may be referred to as an inside 27*b* of the panels 19. The raised faces 26 may be designed to represent other decorative units, including shakes, tiles, et cetera.

A plurality of recessed keyways 28 are formed between each of the raised faces 26. The keyways 28 define grooves or channels and link each of the raised faces 26. The keyways 28 are formed from the same substrate material as the raised faces 26 and are recessed from the raised faces 26 toward the mounting surface 12 or the mounting plane that represents the mounting surface 12 to which the panels 19 may subsequently be attached. The keyways 28 may simulate the empty horizontal gap between individual wooden shingles in traditional shingle siding.

Note that the second panel 16 may have raised faces 26 of different size, number, or both, relative to the first panel 14. Such that the keyways 28 may be spaced at different intervals on each of the panels 19. Furthermore, even on panels intended to be identical, such as multiple copies of the first panel 14, manufacturing differences may exist.

The keyways 28 are staggered such that they appear to be randomly located, in order to better approximate the aesthetics of natural wooden shingles. The patterns of the keyways 28 vary across a pre-set number of panels 19, which are then assembled onto the mounting surface to approximate wooden shingles. Ideally, the keyways 28 of vertically-adjacent panels 19 never align, irrespective of the order in which the first panel 14, the second panel 16, and the third panel 18 are assembled, and irrespective of staggering or cut-off lines on the panels 19.

The keyways 28 are located on the various panels 19 based upon a formula or algorithm. Illustrative formulas or algorithms for locating the keyways 28 may be found in U.S. patent application Ser. No. 13/746,133, filed Jan. 21, 2013, the entirety of which is hereby incorporated by reference.

A side lap 30 is formed on the edge of the panels 19. The side lap 30 facilitates horizontal assembly or mating of the panels 19. For example, another panel 19 may be placed to the right of the first panel 14 and would cover the side lap 30 on the first panel 14.

Figure 3B:
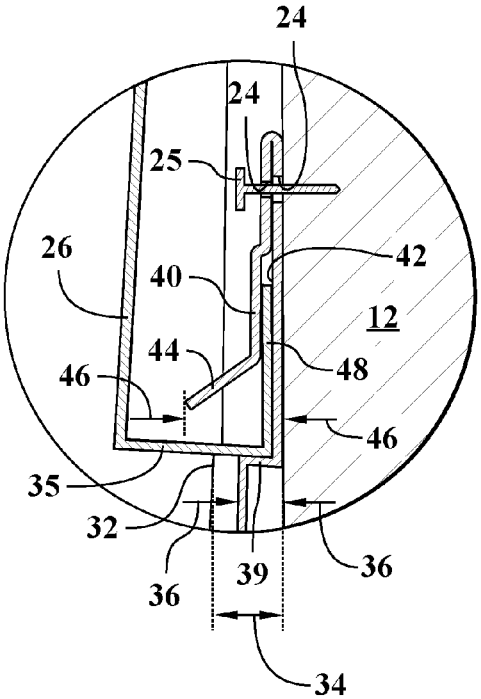
FIG. 3B is a schematic detail view from area B of FIG. 2, illustrating an intersection without the keyway-lap between the panels.
Figure 3A:
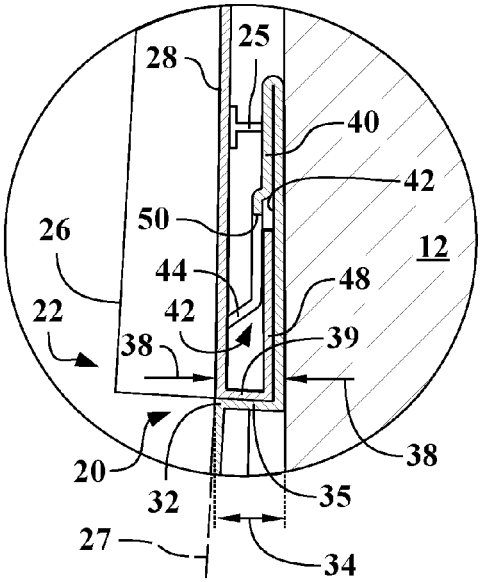
FIG. 3A is a schematic detail view from area A of FIG. 2, illustrating a keyway-lap intersection between the panels.

Referring also to FIG. 3A and FIG. 3B, and with continued reference to FIGS. 1-2, there are shown detail views of junctions or mating regions between adjacent panels 19. FIG. 3A shows a zoomed or detail view of the intersection between the lock edge 20 of the first panel 14 and the butt edge 22 of the second panel 16, and illustrates the interaction between keyways 28 and the lock edges 20. The view of FIG. 3A is taken generally from area 3A in FIG. 2. FIG. 3B shows a zoomed or detail view of the intersection between the lock edge 20 of the second panel 16 and the butt edge 22 of the third panel 18, and illustrates intersections without keyways 28. The view of FIG. 3B is taken generally from area 3B in FIG. 2.

The raised faces 26 define a shoulder 32 adjacent to the lock edge 20. The shoulder 32 is spaced from the mounting surface 12 by a shoulder offset 34. A plurality of face walls 35 provide structures spacing the raised faces 26 from the mounting surface 12, as shown adjacent the shoulder 32 in FIG. 3A. As shown in the figures, the shoulder offset 34 is measured on the raised faces 26, at the face plane 27, as opposed to nearer the mounting surface 12 or elsewhere along the face walls 35. Alternatively stated, and as viewed in the figures, the shoulder offset 34 is defined on the side of the raised faces 26 that is opposite the mounting surface 12. Furthermore, the shoulder 32 provides an abutment face or surface for interface between the lock edge 20 of one of the panels 19 and the butt edge 22 of another of the panels 19.

The keyways 28 are spaced from the mounting surface 12 by a top keyway offset 36 adjacent to the lock edge 20 and by a bottom keyway offset 38 adjacent to the butt edge 22. A plurality of wall or keyway walls 39 provide structures spacing the keyways 28 from the mounting surface 12, as shown adjacent bottom keyway offset 38 in FIG. 3A. As shown in the figures, both the top keyway offset 36 and the bottom keyway offset 38 are measured from the side of the keyways 28 that is opposite the mounting surface 12, which is to the left in the figures, as opposed to the side of the keyways 28 nearer the mounting surface 12. In the configuration of the panels 19 shown, the bottom keyway offset 38 is substantially equal to the shoulder offset 34. Note that, as shown in the figures, both the bottom keyway offset 38 and the shoulder offset 34 are measured from the mounting surface 12 or mounting plane formed by the rearward side of the panels 19.

Alignment of the bottom keyway offset 38 and the shoulder offset 34 also applies to panels 19 having the lock edge 20 and the butt edge 22 reversed, such that the panels 19 are fastened at the bottom. Furthermore, configurations of panels 19 that do not include the lock edge 20—such as head-lap configurations where there is no direct locking between vertically-adjacent panels—may still have the bottom keyway offset 38 substantially equal to the shoulder offset 34.

Alternatively, the bottom keyway offset 38 may be measured from the back side of the panels 19, such that the shoulder offset 34 is substantially equal to the bottom keyway offset 38 plus the thickness of the substrate forming the panels 19. Therefore, the bottom of the keyway 28 on the second panel 16 is substantially aligned with the shoulder 32 of the first panel 14, which simulates the look of two wooden shingles partially covering and overlapping a lower wooden shingle.

As used herein, substantially equal refers to quantities, values, or dimensions that are within manufacturing variance or tolerance ranges of being perfectly equal. Substantially equal dimensions, for example, may be planned as ideally equal but normal manufacturing tolerances may cause the resulting dimensions to vary by 10-20% for different pieces.

Depending on the materials and the surface textures of the panels 19, the bottom keyway offset 38 may differ from the shoulder offset 34 by up to 10% in many configurations. In systems with surface textures having very aggressive wood grains, the bottom keyway offset 38 may differ from the shoulder offset 34 by up to 15% and still be considered as substantially equal because the visual appearance will still show that the bottom of the keyway 28 on the second panel 16 is substantially aligned with the shoulder 32 of the first panel 14 to simulate natural wooden shingles.

A lock flange 40 is formed on the lock edge 20 and extends away from the mounting surface 12. Although not generally needed to hold the first panel 14 to the mounting surface 12 with the fastener 25, the lock flange 40 creates depth or thickness from the mounting surface 12 at the lock edge 20.

A lock slot 42, or overlap portion, is formed on the lock edge 20 and at least partially defined by the lock flange 40. The lock slot 42 opens toward the butt edge 22. As shown in the figures, the butt edge 22 of the second panel 16 mates with the lock flange 40 of the first panel 14.

A lock tab 44 is also formed on the lock flange 40 and extends at an angle to the mounting surface 12. The lock tab 44 is spaced from the mounting surface 12 by a lock flange offset 46, which is determined at the furthest edge of the lock tab 44, as shown in FIG. 2.

Assembly of the illustrated siding system 10 may involve a bottom-up process. For example, the first panel 14 may be aligned on the mounting surface 12 and then attached by driving fasteners 25 through the fastener holes 24. Additional panels may then be placed to the right or left, as viewed in FIG. 1, of the first panel 14 and attached to the mounting surface 12. Therefore, the first panel 14 may be part of a first course or first row, which extends horizontally from the first panel 14.

A second course of panels may then be placed on the mounting surface 12 above the first course. The second panel 16 is aligned above the first panel 14, as viewed in FIG. 1 and FIG. 2. The lock tab 44 of the second panel 16 is inserted into the lock slot 42 of the first panel 14. The butt edge 22 of the second panel 16 is aligned to generally abut the top of the raised faces 26 of the first panel 14. This gives the appearance that the second panel 16 is formed from individual wood shingles laid partially over the top of wood shingles below, on the first panel 14.

The butt edge 22 shown includes a lap portion 48, which is used to interface the second panel 16 with the first panel 14. The lap portion 48 slides into the lock slot 42. During installation, the lap portion 48 of the second panel 16 is inserted into the lock slot 42 of the first panel 14, and fasteners 25 are then inserted though the fastener holes 24 to affix the second panel 16 to the mounting surface 12.

The lock flange offset 46 of the lock tab 44 is greater than the bottom keyway offset 38. Therefore, the panels 19 are configured such that the keyways 28 of the second panel 16 cannot be coincident with the lock tab 44 of the first panel 14. Otherwise, the installer may not be able to assemble the second panel 16 to the first panel 14.

The panels 19 include a plurality of flange cutouts 50 defined in the lock edge 20. The flange cutouts 50 on the first panel 14 and the second panel 16 are hidden from view in FIG. 1, but are viewable on the upper portion of the third panel 18 in FIG. 1. Portions of the flange cutouts 50 are also viewable in the cross-sectional views.

The flange cutouts 50 are portions of the lock edge 20 that do not include at least the lock tab 44 of the lock flange 40. Therefore, the flange cutouts 50 provide space for the keyways 28 of adjacent, upper panels 19 to be assembled or mated to the lock flange 40, as illustrated by the intersection between the first panel 14 and the second panel 16 shown in FIG. 3A. The back side of the keyways 28 of the third panel 18 are shown in solid lines in FIG. 3B, with the front side shown in phantom. As illustrated in FIG. 3B, the lock tab 44 extends further from the mounting surface 12—and into the space behind the raised faces 26—than the keyways 28.

The flange cutouts 50 formed on the first panel 14 provide space for the keyways 28 of the second panel 16. Otherwise, the backside of the keyways 28 of the second panel 16 would contact the lock tab 44 of the first panel 14. The flange cutouts 50 shown in the figures are generally arch-shaped. However, the flange cutouts may be rectangular, trapezoidal, or other suitable shapes defining space for the keyways 28 of adjacent panels 19.

As best viewed in the FIG. 3B on the second panel 16, the fastener holes 24 pass through two layers of the material forming the panels 19, such that each fastener 25 passes through two fastener holes 24. In many configurations, the panels 19 will be manufactured by folding the lock flange 40 to formed the lock slot 42 during forming of the panel 19, and the fastener holes 24 may be formed prior to the folding operation. Therefore, an interior portion (to the right, as viewed in FIG. 3B) of the fastener hole 24 may be formed with a larger diameter than an exterior portion (to the left, as viewed in FIG. 3B).

The escalating-diameter configuration of the fastener holes 24 shown in FIG. 3B improves installation when manufacturing variability alters the location of one, or both, of the fastener holes 24. The smaller hole is more likely to be coincident with the larger hole if either is offset, but the smaller hole still provides surface contact for the head of the fastener 25.

Additionally, as best viewed on the third panel 18 in FIG. 1, the fastener holes 24 may not be formed in areas where adjacent keyways 28 will intersect the third panel 18. Location of the fastener holes 24 is also illustrated through a comparison of the portion of the lock edge 20 of the first panel 14 shown in FIG. 3A with the portion of the lock edge 20 of the second panel 16 shown in FIG. 3B.

The fasteners 25 will often not be driven tightly against the lock flange 40. Leaving the fasteners 25 extended slightly may allow for slight movement, expansion, and contraction of the panels 19. However, the fasteners 25 may then come into contact with keyways 28 from subsequently-added panels 19. Therefore, in areas where an adjacent keyway 28 will intersect the first panel 14, as shown in FIG. 3A, there are no fastener holes 24, such that an installer will not insert the fastener 25 in those areas. However, where there is no keyway 28 adjacent to the second panel 16, as shown in FIG. 3B, there is sufficient room for the fastener 25 to extend away from the mounting surface 12. The fastener 25 viewable in FIG. 3A is in the background from the plane of the cross section.

As best viewed in FIG. 1 (and also in FIG. 4) the panels 19 may be configured such that there are no fastener holes 24 formed through the lock edge 20 above the flange cutouts 50. Both the flange cutouts 50 and the portions of the lock flange 40 formed without the fastener holes 24 are located at areas in which adjacent keyways 28 of the subsequent panel 19 will intersect. Therefore, the flange cutouts 50 and fastener holes 24 (or lack thereof) are located based upon the formula or algorithm used to located the keyways 28 on the various panels 19.

Figure 4:
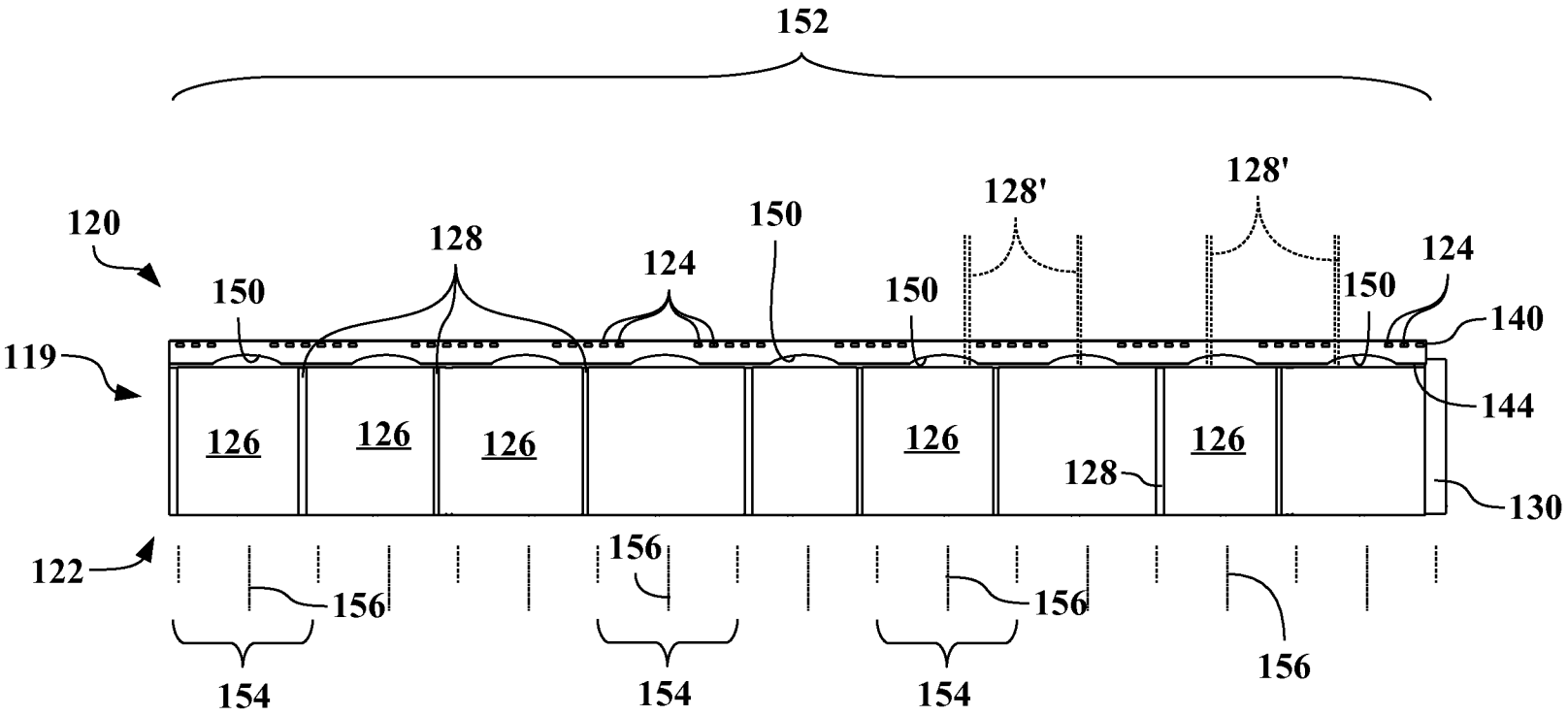
FIG. 4 is a schematic plan view of a panel for a siding system, illustrating locations of elements and features of the panel.

Referring now to FIG. 4, and with continued reference to FIGS. 1-3B, there is shown a schematic view of a panel 119, which may be used with the siding system 10. The panel 119 is similar to the panels 19 and identical or similar features to those described with respect to the panels 19 may not be separately described.

The panel 119 includes a lock edge 120 defined along one edge, and is shown on the upper edge in FIG. 4. A butt edge 122 is defined opposite the lock edge 120, and is shown on the lower edge in FIG. 4. The lock edge 120 has a plurality of fastener holes configured to mount the panels 119 to a mounting surface (not shown or numbered) with a plurality of fasteners (not shown), which may include nails, screws, staples, et cetera.

A plurality of raised faces 126 are formed between the lock edge 120 and the butt edge 122. The raised faces 126 shown generally simulate wooden shingles, and have variable widths, as shown in FIG. 4. The raised faces 126 may be designed to represent other decorative units, including shakes, tiles, et cetera. A plurality of keyways 128 are recessed between each of the raised faces 126 and link or form connections between each of the raised faces 126. The keyways 128 extend from the raised faces 126 toward the mounting surface 112, and may simulate the empty space between conventional shingles.

A side lap 130 is formed on the edge of the panel 119. The side lap 130 facilitates horizontal assembly or mating of multiple panels 119. A lock flange 140 is formed on the lock edge 120 and extends away from the mounting surface 112. The lock flange 140 creates depth or thickness from the mounting surface at the lock edge 120 and includes a lock tab 144. The lock flange 140 mates with the butt edge 122 of adjacent panels 119.

A plurality of flange cutouts 150 are defined in the lock edge 120 of the panel 119. The flange cutouts 150 are portions of the lock edge 120 that do not include at least a portion of the lock flange 140, particularly the lock tab 144. Therefore, the flange cutouts 150 provide space for the keyways 128 of adjacent, upper panels 119 to be assembled or mated to the lock flange 140.

The keyways 128 are located based upon an algorithm or formula and vary in relative location across the panel 119. Therefore, unless subsequent panels 119 will be assembled in a very specific pattern, which may be cumbersome on installers, the exact location of the keyways 128 for the subsequent panel that will be assembled above the panel 119 are unknown. A plurality of subsequent keyways 128' are illustrated in phantom above a portion of the panel 119 in FIG. 4.

As shown in FIG. 4, the panel 119 defines a panel length (PL) 152, which is the sum of widths of the raised faces 126 and the keyways 128. The number of the raised faces 126, and also of the keyways 128, defines a number (n) of shingles represented on the panel 119. As shown in FIG. 4, there are nine shingles on the panel 119, such that n=9. Dividing the number of shingles by the panel length 152 yields an average shingle distance (ASD) 154, such that ASD=PL/n.

The keyways 128 are not spaced from each other by the ASD, such that the distance between keyways 128 varies. However, a few of the keyways 128 nearly coincide with the actual average shingle distances, as shown in FIG. 4. Several of the keyways 128 are spaced by greater margins than the ASD and several are spaced by smaller margins.

An average center 156 is located at the center of each ASD 154, and represents the average location of the center of each of the shingles. The flange cutouts 150 are located at the average centers 156. The flange cutouts 150 are located to ensure that the subsequent keyways 128' do not intersect the lock tab 144 of the lock flange 140. Contact between the lock tab 144 and the subsequent keyways 128' may prevent the next panel 119 from being properly installed.

As illustrated with the panel system 10 shown in FIG. 1, multiple—although not identical—panels 119 are layered upon each other. Subsequent courses of panels may be offset by any multiple of ½ ASD, which will result in the subsequent keyways 128' of the subsequent (upper) panels 119 coinciding with some portion of the flange cutouts 150.

Additionally, a cutout width (CW) of the flange cutouts 150 is sized to account for the variability of the subsequent keyways 128'. Large (wide) flange cutouts 150 allow for greater flexibility of location for the subsequent keyways 128'. However, large flange cutouts 150 also reduce the rigidity of the panel 119 by removing portions of the lock flange 140 and the lock tab 144. Furthermore, in configurations where the fastener holes 124 are removed, large flange cutouts 150 also reduce the availability of attachment points by reducing the number of fastener holes 124 for the panels 119 to the mounting surface.

Numerical examples of the panels 119 are given herein, for illustrative purposes only, to demonstrate location and sizing of the flange cutouts 150. The panel length 152 of the panel 119 shown in FIG. 4 may be PL=60 inches. Therefore, because ASD=PL/n, the ASD is approximately 6.67 inches, such that the flange cutouts 150 are spaced apart by 6.67 inches.

The keyways 128 and subsequent keyways 128' may be located based upon an algorithm that limits the width of the shingles to between a shingle minimum (S_min) and a shingle maximum (S_max). For example, S_min may be approximately 5 inches and S_max may be approximately 8 inches.

Within the same panel 119, the flange cutouts 150 do not intersect or overlap with the keyways 128. Therefore, one scheme for sizing the flange cutouts 150 would be to extend them over substantially the entire width of the raised faces 126, such that each flange cutout 150 spanned from the edge of one keyway 128 to the edge of another. However, this would result in flange cutouts 150 having variable widths, which may increase manufacturing difficulty, and would severely limit the number of fastener holes 124.

The width of the flange cutouts 150 may also be determined as a percentage or ratio of either the maximum shingle width or the minimum shingle width. For example, the cutout width (CW) may be less than 60% of the minimum shingle width, such that CW=0.6*S_min, which is approximately 3 inches. CW may also be determined as less than 40% of the maximum shingle width, such that CW=0.4*S_max, which is approximately 3.2 inches.

Alternatively, the cutout width (CW) may be based upon the allowable overlap or stacking differential for the keyways 128. An allowable keyway offset (KO) of the keyways 128 is the minimum distance at which vertically-adjacent keyways 128 will be considered as "stacked." If the KO is 1 inch, no subsequent keyway 128' may be with 1 inch of any of the keyways 128. Otherwise, the subsequent keyway 128' would be considered as stacked (i.e., vertically-aligned) with the keyway 128, which would not occur with properly-assembled natural wooden shingles. Therefore, the width of the flange cutouts 150 may be determined as: CW=S_min−(2*KO), which is 3 inches in the above illustration.

The detailed description and the drawings or figures are supportive and descriptive of the invention, but the scope of the invention is defined solely by the claims. While some of the best modes and other embodiments for carrying out the claimed invention have been described in detail, various alternative designs, configurations, and embodiments exist for practicing the invention defined in the appended claims.

The invention claimed is:

1. A panel configured for attachment to a mounting surface, comprising:

a plurality of raised faces formed, and extending substantially continuously, between an upper edge and a lower edge of the panel, wherein the raised faces are configured to be spaced from the mounting surface by greater than a substrate thickness of the panel;

a shoulder defined on the raised faces adjacent the upper edge, wherein the shoulder is configured to be spaced from the mounting surface by a shoulder offset, wherein the raised faces define a face plane, and the face plane is spaced from the mounting surface by the shoulder offset at the shoulder of the raised faces;

a plurality of keyways defined between each of the raised faces, and recessed from the face plane of the raised faces, wherein the keyways are configured to be spaced from the mounting surface by a bottom keyway offset adjacent to the lower edge; and wherein the bottom keyway offset is substantially equal to the shoulder offset, such that the face plane of the raised faces at the upper edge of the panel are spaced from the mounting surface by substantially the same distance as the keyways at the lower edge of the panel.

2. The panel of claim 1, further comprising:

a lock edge defined on the upper edge of the panel, wherein the lock edge is configured to be substantially coincident with the mounting surface;

a butt edge defined on the lower edge of the panel, such that the butt edge is opposite the lock edge;

a lock flange formed on the lock edge and extending away from the mounting surface when the panel is attached to thereto, wherein a portion of the lock flange is at an angle to the mounting surface and is spaced from the mounting surface by a lock flange offset;

a lock slot defined by the lock flange; and wherein the lock flange offset is greater than the bottom keyway offset.

3. The panel of claim 2, further comprising:

a plurality of flange cutouts defined in the upper edge, wherein the flange cutouts are portions of the lock edge that do not include the lock flange.

4. The panel of claim 3, wherein the keyways extend substantially continuously in the vertical direction, without horizontal interruption, from the upper edge to the lower edge of the panel.

5. The panel of claim 4, further comprising:

a plurality of fastener holes defined through the lock edge, wherein the fastener holes are defined through portions of the lock edge that do not include flange cutouts.

6. The panel of claim 2, further comprising:

a plurality of fastener holes defined through the lock edge, wherein the fastener holes are defined through portions of the lock edge that do not include flange cutouts.

7. The panel of claim 1, wherein the keyways extend substantially continuously in the vertical direction, without horizontal interruption, from the upper edge to the lower edge of the panel.

* * * * *